United States Patent [19]

Caldwell

[11] Patent Number: 5,048,380

[45] Date of Patent: Sep. 17, 1991

[54] ADJUSTABLE WRENCH

[76] Inventor: Mark A. Caldwell, 872 Apache Trail, Lexington, Ky. 40503

[21] Appl. No.: 481,189

[22] Filed: Feb. 20, 1990

[51] Int. Cl.[5] ..... B25B 13/16

[52] U.S. Cl. ..... 81/165; 81/155; 81/129

[58] Field of Search ..... 81/165, 155, 129.5, 81/129

[56] References Cited

U.S. PATENT DOCUMENTS

| | | | |
|---|---|---|---|
| 1,490,903 | 4/1924 | Anderson | 81/165 |
| 2,112,193 | 3/1938 | Geddes . | |
| 2,534,985 | 12/1950 | Napier . | |
| 3,564,956 | 2/1971 | Landen . | |
| 3,659,485 | 5/1972 | Roth . | |
| 3,926,077 | 12/1975 | Nordgren . | |

*Primary Examiner*—Frederick R. Schmidt
*Assistant Examiner*—Lawrence Cruz
*Attorney, Agent, or Firm*—Jerry T. Kearns

[57] ABSTRACT

An adjustable wrench has a stationary jaw formed at an end of a handle. A slidable jaw is mounted for linear reciprocal movement toward and away from the stationary jaw by a worm gear in mesh with a gear rack on the slidable jaw. An axially movable shaft extends through the worm gear. The worm gear is rotatably mounted on the shaft, and restrained against axial movement relative thereto. An inner end of the shaft is slidably received in a recess in the handle, and a coil spring in the recess outwardly biases the shaft. A lever has a first end pivotally mounted to an outer end of the shaft and an intermediate portion pivotally secured to the handle. The slidable jaw may be moved by rotation of the worm gear to a loosely adjusted position and may be firmly tightened into engagmeent with the head of a fastener by manipulation of the pivotal lever. The wrench allows extremely quick engagement and release with the head portions of various fasteners.

5 Claims, 3 Drawing Sheets

ADJUSTABLE WRENCH

BACKGROUND OF THE INVENTION

1. Field of the Invention

The present invention relates to adjustable wrenches, and more particularly pertains to adjustable wrenches of the type having a stationary jaw formed at an end of a handle and a slidable jaw mounted for linear reciprocal movement toward and away from the stationary jaw by a worm gear in mesh with a gear rack on the slidable jaw. These conventional forms of wrenches must be precisely adjusted for conformance with the head of a fastener to be rotated. In order to avoid rounding off the fastener head, the worm gear must be rotated manually when the wrench is placed into engagement with the head of each fastener. Subsequently, the worm gear must be rotated in an opposite direction to allow disengagement of the wrench from the fastener head. In order to overcome these problems, the present invention provides a pivotal lever which causes axial movement of the worm gear to effect tightening and release of the slidable jaw sufficiently to allow engagement and disengagement of the wrench in an expedient manner.

2. Description of the Prior Art

Various types of adjustable wrenches are known in the prior art. A typical example of such an adjustable wrench is to be found in U.S. Pat. No. 2,112,193, which issued to J. Geddes on Mar. 22, 1938. This patent discloses an adjustable wrench which utilizes a worm gear and gear rack mechanism. U.S. Pat. No. 2,534,985, which issued to M. Napier on Dec. 19, 1950, discloses a sliding jaw wrench which utilize a compound pivotal linkage to tighten a V-shaped slidable jaw. U.S. Pat. No. 3,564,956, which issued to B. Landen on Feb. 23, 1971, discloses a locking flier type wrench which utilizes a compound pivotal linkage to tighten a sliding jaw into engagement with the head of a fastener. U.S. Pat. No. 3,659,485, which issued to A. Roth on May 2, 1972, discloses an adjustable open end wrench having one jaw member pivotally attached to a handle and a second jaw member slidably received by the handle juxtaposed the pivotal jaw. The sliding jaw is spring biased out of the handle and into a closing relationship with the fixed jaw. U.S. Pat. No. 3,926,077, which issued to S. Nordgren on Dec. 16, 1975, discloses an adjustable wrench which utilizes a worm gear and gear rack mechanism to close a slidable jaw relative to a stationary jaw. The wrench head is pivotally mounted at the end of the handle to provide a ratchet action.

While the above mentioned devices are directed to adjustable wrenches, none of these devices disclose a wrench in which a slidable jaw movable by a worm gear in mesh with a gear rack on the slidable jaw has a pivotal lever mechanism operative to effect axial movement of the worm gear. Inasmuch as the art is relatively crowded with respect to these various types of adjustable wrenches, it can be appreciated that there is a continuing need for and interest in improvements to such adjustable wrenches, and in this respect, the present invention addresses this need and interest.

SUMMARY OF THE INVENTION

In view of the foregoing disadvantages inherent in the known types of adjustable wrenches now present in the prior art, the present invention provides an improved adjustable wrench. As such, the general purpose of the present invention, which will be described subsequently in greater detail, is to provide a new and improved adjustable wrench which has all the advantages of the prior art adjustable wrenches and none of the disadvantages.

To attain this, a representative embodiment of the concepts of the present invention is illustrated in the drawings and makes use of an adjustable wrench which has a stationary jaw formed at an end of a handle. A slidable jaw is mounted for linear reciprocal movement toward and away from the stationary jaw by a worm gear in mesh with a gear rack on the slidable jaw. An axially movable shaft extends through the worm gear. The worm gear is rotatably mounted on the shaft, by restrained against axial movement relative thereto. An inner end of the shaft is slidably received in a recess in the handle, and a coil spring in the recess outwardly biases the shaft. A lever has a first end pivotally mounted to an outer end of the shaft and an intermediate portion pivotally secured to the handle. The slidable jaw may be moved by rotation of the worm gear to a loosely adjusted position and may be firmly tightened into engagement with the head of a fastener by manipulation of the pivotal lever. The wrench allows extremely quick engagement and release with the head portions of various fasteners.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable wrench which has all the advantages of the prior art adjustable wrenches and none of the disadvantages.

It is another object of the present invention to provide a new and improved adjustable wrench which may be easily and efficiently manufactured and marketed.

It is a further object of the present invention to provide a new and improved adjustable wrench which is of a durable and reliable construction.

An even further object of the present invention is to provide a new and improved adjustable wrench which is susceptible of a low cost of manufacture with regard to both materials and labor, and which accordingly is then susceptible of low prices of sale to the consuming public, thereby making such adjustable wrenches economically available to the buying public.

Still yet another object of the present invention is to provide a new and improved adjustable wrench which provides in the apparatuses and methods of the prior art some of the advantages thereof, while simultaneously overcoming some of the disadvantages normally associated therewith.

Still another object of the present invention is to provide a new and improved adjustable wrench which is quickly releasable from engagement with the head of a fastener.

Yet another object of the present invention is to provide a new and improved adjustable wrench which allows an initial coarse adjustment of the wrench and a final pivotal clamping of the wrench into engagement with the head of a fastener.

Even still another object of the present invention is to provide a new and improved adjustable wrench in which a movable jaw is easily maintained in clamping engagement with the head of a fastener.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
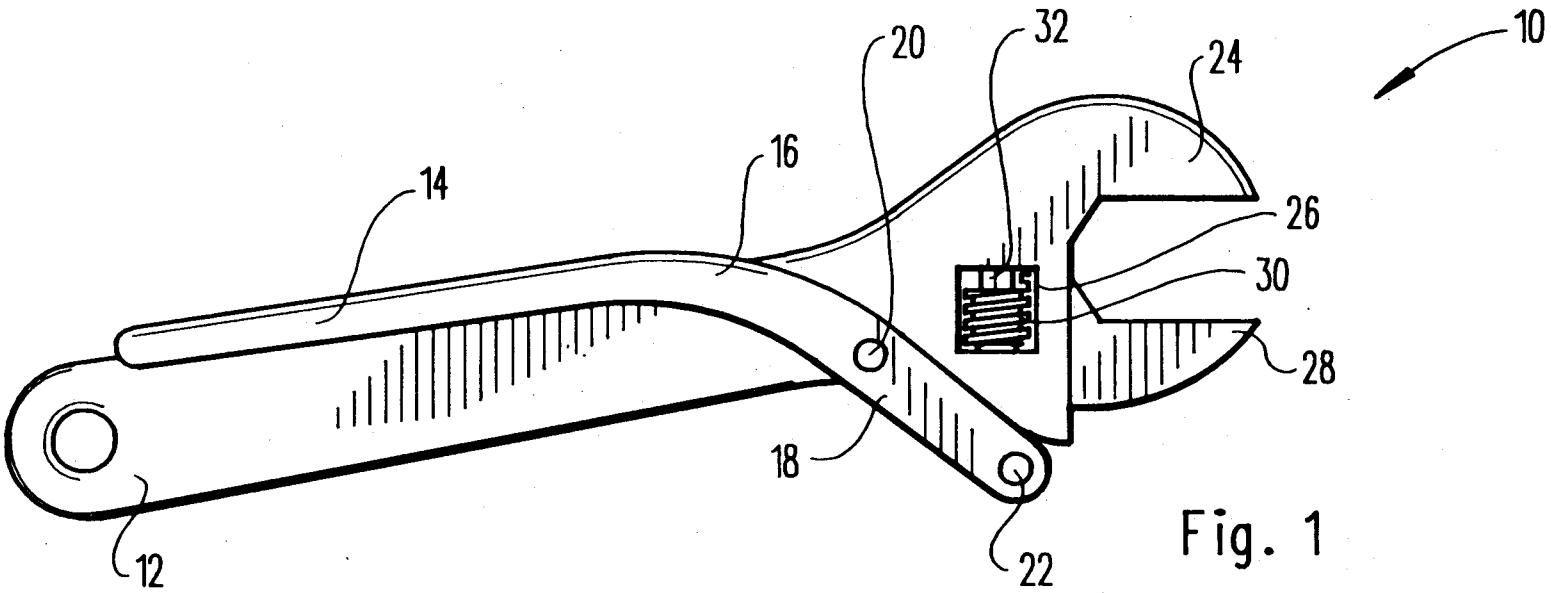
FIG. 1 is a side view of the adjustable wrench of the present invention.

With reference now to the drawings, and in particular to FIG. 1 thereof, a new and improved adjustable wrench embodying the principles and concepts of the present invention and generally designated by the reference numeral 10 will be described.

More specifically, it will be noted that the first embodiment 10 of the invention includes an adjustable wrench including a handle 12 having a stationary jaw 24 formed at a forward end thereof. The wrench may be an offset-type wrench, with the jaw 24 laterally offset with respect to the handle 12. A rectangular opening 26 is formed through the handle 12, adjacent the stationary jaw 24 in a conventional manner. A slidable jaw 28 is slidably mounted in a groove provided in the forward end face of the handle 12, also in a conventional fashion. A worm gear 30 is disposed within the rectangular opening 26, and in mesh with a gear rack provided on an inner portion of the slidable jaw 28. Thus, in a conventional manner, rotation of the worm gear 30 effects reciprocal linear movement of the slidable jaw 28 toward and away from the stationary jaw 24. The improvement of the present invention provides an axially movable shaft 32 on which the worm gear 30 is rotatably mounted. The worm gear 30 is constrained against axial movement with respect to the shaft 32 such that axial movement of the shaft 32 effects axial movement of the worm gear 30. A pivotal lever 14 has a bifurcated end yoke portion 18 secured by a pivotal mounting pin 20 to a central portion of the handle 12, adjacent the forward end portion. An extreme end portion of the bifurcated yoke portion 18 is secured by a pivot pin 22 to an outer end of the shaft 32. Thus, the pivotal lever 14 effects axial movement of the shaft 32, resulting in axial movement of the worm gear 30, and slidable movement of the jaw 28. Thus, the slidable jaw 28 may be adjusted by rotating the worm gear 30, or by manipulation of the lever 14.

Figure 2:
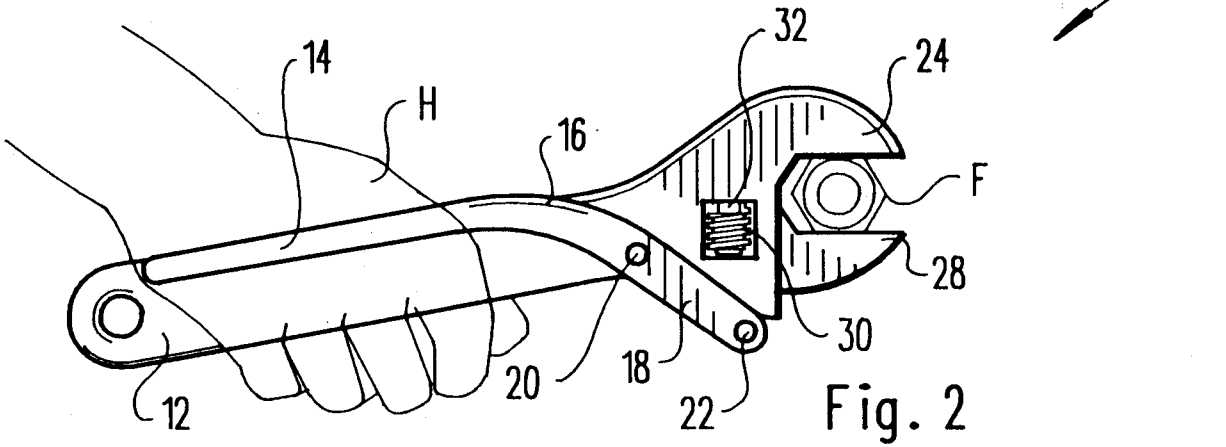
FIG. 2 illustrates the manner of utilizing the wrench of the present invention.

FIG. 2 illustrates the manner of use the wrench 10 of the present invention. The jaws 24 and 28 are adjusted to a spacing sufficient to allow a loose slip fit of the head of a fastener F. This preliminary adjustment is effected by rotation of the worm gear 30. Upon placement of the jaws 24 and 28 into a slip fit engagement with the fastener F, the pivotal lever 14 is depressed against the handle 12 by the hand H of a user. This effects inward axial movement of the shaft 32, worm gear 30 and causes a final tightening of the slidable jaw 28 into an extremely firm engagement with the fastener F. Upon completion of a tightening operation, an individual releases the pivotal lever 14, allowing release of the slidable jaw 28 from a clamping engagement with the fastener F. This allows a quick disengagement of the wrench from the fastener F, which avoids the necessity of cumbersome and repeated manual manipulation of the worm gear 30.

Figure 3:
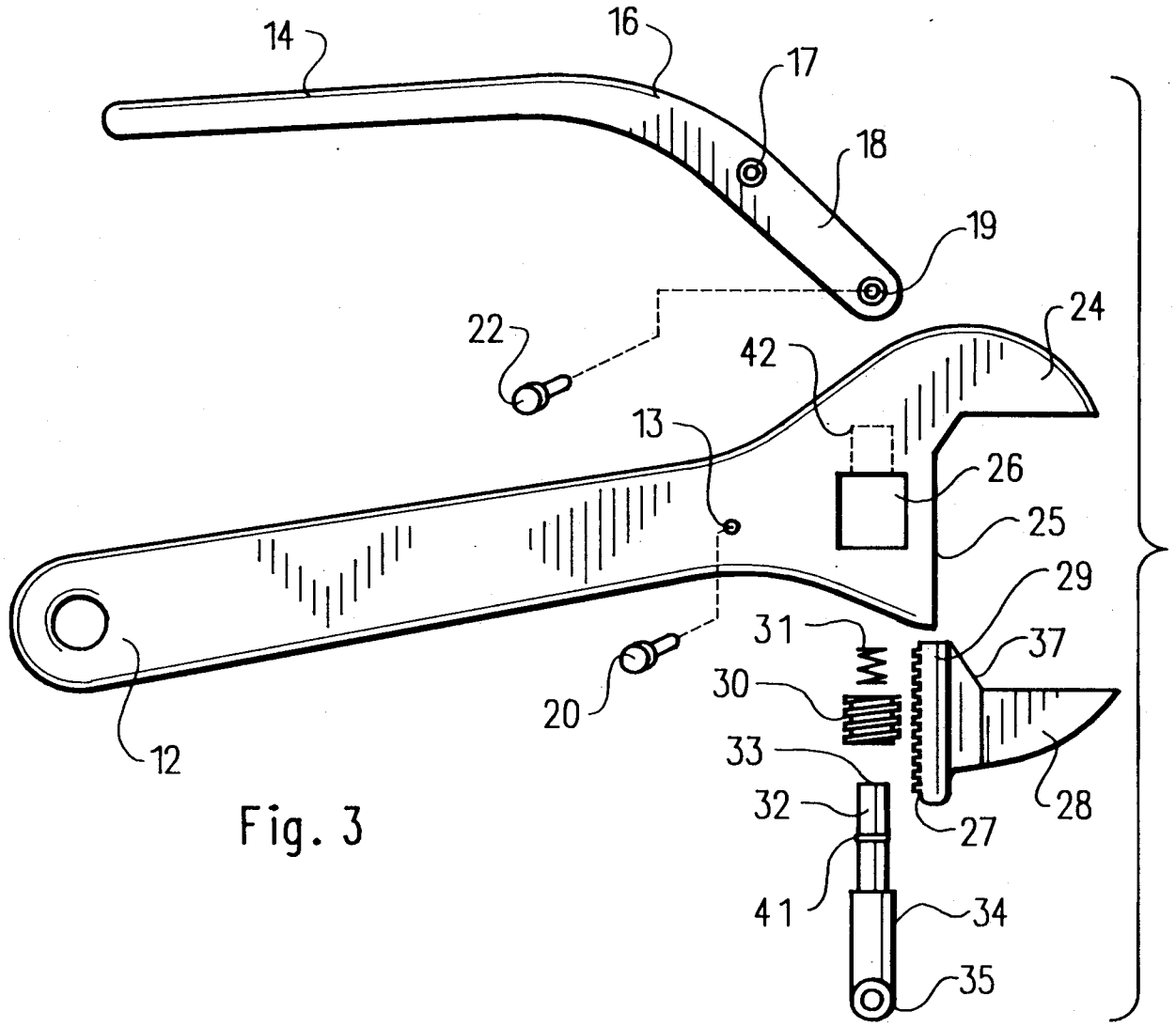
FIG. 3 is an exploded side view illustrating the various components of the wrench of the present invention.

FIG. 3 is an exploded side view illustrating the various components of the wrench of the present invention. An elongated handle 12 has a stationary jaw 24 formed at a forward end of the handle 12, in a conventional fashion. A lever 14 has a bifurcated end yoke portion 18 connected by a radiused bend 16 with the lever portion 14. A pair of apertures 17 and 19 extend transversely through the bifurcated yoke portion 18. A first pivotal mounting screw, pin or rivet 20 extends through a first leg of the bifurcated yoke 18, through the transverse aperture 17 and through the aperture 13 formed through the handle 12. The pivot pin member 20 then extends through the opposite side of the bifurcated yoke portion 18. A slidable jaw 28 is received in a groove formed in an end wall 25 of the handle 12, in a conventional manner. The slidable jaw 28 has an enlarged base portion 29 provided with a gear rack 27. A tapering flange 37 connects the base portion 29 with the jaw 28.

A worm gear 30 is rotationally mounted on a cylindrical shaft 32, between a snap ring 41 and an enlarged diameter shaft portion 34. The shaft portion 34 is received for axial sliding movement through a cylindrical bore 43 formed in the handle 12, coaxial with a recess 42 and communicating with the opening 26. The worm gear 30 is thus mounted for rotation with respect to the shaft 32, but constrained against relative axial movement relative thereto. The worm gear 30 is in effect captured between the snap ring 41 and the enlarged diameter shaft portion 34. The reduced diameter inner end 32 of the shaft 34 has an end face 33 in abutment with a coil spring 31. The end portion 32 and coil spring 31 are received in a cylindrical recess 42 formed in the handle 12, adjacent the stationary jaw 24. The opposite end of the shaft 34 is provided with a pivotal bushing 35, which is received in the bifurcated yoke portion 18 of the lever 14. A pivot pin, screw, or rivet 22, extends through the aperture 19 in a first leg of the yoke 18, through the pivot bushing 35, and subsequently through the opposite parallel leg of the bifurcated yoke portion 18. Thus, the slidable jaw 28 may be moved with respect to the stationary jaw 24 by rotation of the worm gear 30 on the shaft 32, or by axial movement of the worm gear 30 with the shaft 32, effected by movement of the pivotal lever 14.

Figure 4:
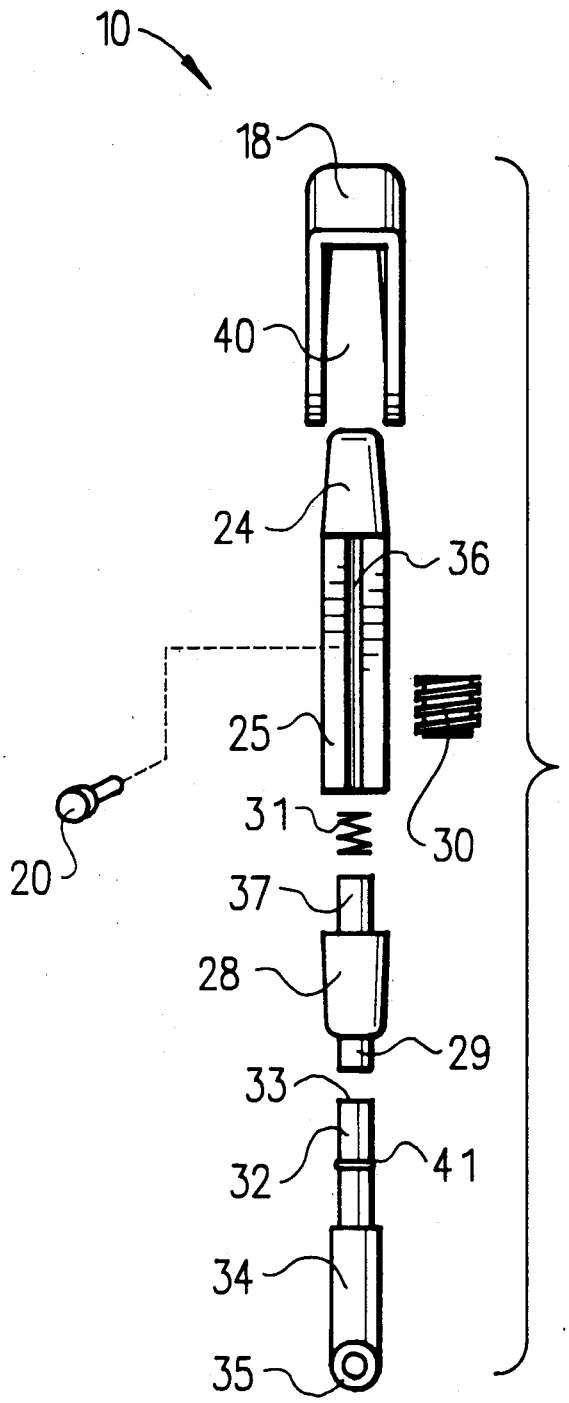
FIG. 4 is an exploded front end view, further illustrating the components of the wrench of the present invention.

FIG. 4 is an exploded front view which illustrates the slot 36 formed through the front end wall 25 of the wrench handle, adjacent the stationary jaw 24. The slidable jaw 28 is mounted for movement along the groove 36, in a conventional fashion.

Figure 5:
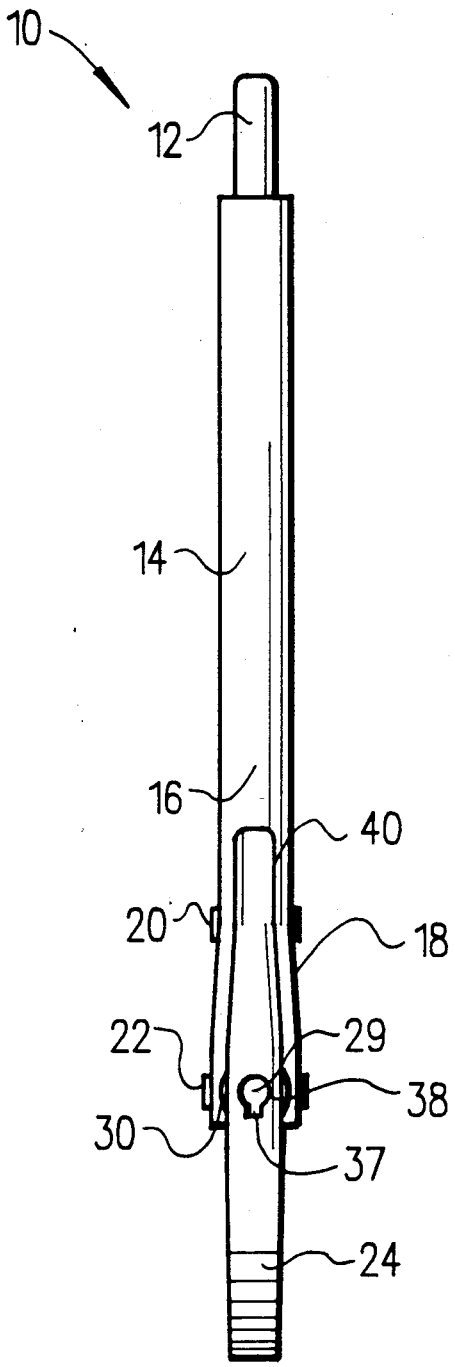
FIG. 5 is a top plan view illustrating the wrench of the present invention.

FIG. 5 illustrates a top view of the wrench 10. The base portion 29 of the slidable jaw extends through a keyhole-shaped aperture 38 in a top surface of the wrench handle 12, adjacent the stationary jaw 24. This construction is conventional, and constrains the slidable jaw to non rotational linear movement. The bifurcated construction of the yoke 18 is shown. The yoke 18 has a slot 40 which receives the forward end portion of the handle 12, and the pivot members 20 and 22 extend through both parallel legs of the yoke portion 18. The hand grip portion of the lever 14 may be formed with a U-shaped transverse cross section, to be received in nesting relation over the handle 12.

The various components of the present invention are preferably formed from a hardened steel material to provide a strong and durable tool.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An adjustable wrench, comprising:
an elongated handle;
a first jaw formed at an end of said handle;
a second jaw slidably mounted adjacent said first jaw;
a gear rack secured to said second jaw;
a worm gear rotatably mounted on a shaft, said worm gear constrained against axial movement with respect to said shaft and in mesh with said gear rack;
said shaft mounted in said handle for reciprocal axial linear movement parallel to said gear rack;
and
lever means pivotally secured to said shaft for axially moving said shaft.

2. The adjustable wrench of claim 1, spring means biasing said shaft in a direction to loosen said second jaw.

3. The adjustable wrench of claim 1, wherein said lever means has a slotted yoke portion pivotally secured to said handle.

4. The adjustable wrench of claim 3, wherein said lever is movable to a generally parallel position with respect to said handle.

5. In an adjustable wrench having a handle, a stationary jaw formed at an end of said handle, a slidable jaw mounted for linear reciprocal movement toward and away from said stationary jaw, a gear rack on said slidable jaw and a worm gear in mesh with said gear rack, the improvement comprising:
an axially movable shaft extending through said worm gear;
means rotatably securing said worm gear on said shaft and constraining said worm gear against axial movement with respect to said shaft;
an inner end of said shaft slidably received in a recess in said handle;
a coil spring in said recess outwardly biasing said shaft;
and
a lever having a first end pivotally mounted to an outer end of said shaft, an intermediate portion of said lever pivotally secured to said handle, whereby said slidable jaw may be moved by rotation of said worm gear or by movement of said lever.

* * * * *